US005632097A

United States Patent [19]

Snitchler et al.

[11] Patent Number: 5,632,097

[45] Date of Patent: May 27, 1997

[54] BRINE SHRIMP CYST DRYING DEVICE

[76] Inventors: William H. Snitchler, 5648 S. 1150 West, Ogden, Utah 84405; Randall L. Scholl, 4822 S. 3200 West, Roy, Utah 84067

[21] Appl. No.: 671,159

[22] Filed: Jun. 28, 1996

[51] Int. Cl.[6] ..... F26B 19/00

[52] U.S. Cl. ..... 34/61; 34/166; 34/171; 34/189; 34/194; 34/205

[58] Field of Search ..... 34/61, 85, 87, 34/102, 126, 129, 165, 166, 168, 171, 172, 181, 185, 189, 193, 194, 195, 204, 205, 218

[56] References Cited

U.S. PATENT DOCUMENTS

| | | | |
|---|---|---|---|
| 417,273 | 12/1889 | Parkinson | 34/85 |
| 1,385,927 | 7/1921 | Schaller | 34/193 |
| 1,552,210 | 9/1925 | Bussler | 34/194 |
| 2,174,897 | 10/1939 | Sacket | 34/166 |
| 3,646,688 | 3/1972 | Osterman | 34/168 |
| 3,864,846 | 2/1975 | Hayashi | 34/189 |
| 4,763,572 | 8/1988 | Kuehl | 34/171 X |
| 5,345,693 | 9/1994 | Skjold | 34/61 X |

*Primary Examiner*—John M. Sollecito
*Assistant Examiner*—Steve Gravini
*Attorney, Agent, or Firm*—A. Ray Osburn

[57] ABSTRACT

An apparatus and method for final drying of harvested brine shrimp cysts preparatory to containerization, for subsequent storage and shipment. The device is portable, and may be installed upon the near shore of the shrimp bearing body of water, or upon shrimp harvesting vessels. A closed drying chamber contains a vertically arranged series of cyst drying trays, the cysts cascading downward from tray to tray by gravity assisted by vibration of the trays from top to bottom of the drying chamber. Conveying and lifting apparatus is associated with the chamber to permit the recirculation of the cysts until a sufficient degree of dryness is obtained. Heated air is introduced into the stationary drying chamber. The apparatus provides for final separation of any broken shrimp cysts still remaining.

9 Claims, 9 Drawing Sheets

BRINE SHRIMP CYST DRYING DEVICE

BACKGROUND OF THE INVENTION

1. Field

The field of the invention is apparatus and methods for drying of brine shrimp cysts, and more particularly such apparatus for final drying and screening of the cysts prior to storage in sealed containers.

2. State of the Art

Brine shrimp cysts are typically harvested from the upper layers of dense concentrated brine found, for example, in the Great Salt Lake of Utah, and are typically harvested by seining and bagging. As originally harvested the cysts are accompanied by lake detritus which must in some fashion be removed by washing and screening. This preliminary cleaning of a harvested mass of shrimp cysts may be accomplished by various methods, which are not the subject of the present invention. Preliminary washing and screening with fine mesh sieves are common. Sometimes, the cysts are finally dewatered, generally after washing with fresh water, by use of centrifugal spin tanks.

After cleaning and dewatering, the cysts must however be further dried before being placed in sealed cans for storage and shipment. Damp masses of cysts may be spread in thin layers in trays and allowed to dry, in either atmospheric or oven environments, often accompanied by manual stirring of the mass of cysts at intervals. Generally, with these procedures, individual cysts cake together into crumbly aggregate. Considerably improved methods and apparatus for the final drying of brine shrimp cysts are found in U.S. Pat. Nos. 4,996,780, 5,088,210 and 5,152,079, which disclose variations in rotating drum devices for final drying of shrimp cysts. Heated air is introduced into the interior of a rotating drum into which the damp cysts are placed. The heated air exits the drum through fine mesh screen covering openings in the drum wall, allowing the passage of air but retaining the cysts within the drum. This method of final drying of the cysts is efficient and produces uncaked shrimp cysts for containerization. It does not, however, have any provisions for separating any broken cysts which may remain. These drum devices are not portable, requiring a permanent on shore installation, preferably within a sheltering building. Since considerable time must elapse between the harvest of the shrimp cysts and the final drying using this method, live viable shrimps which may already have been hatched and harvested along with the eggs typically die and are thus lost to aid in replenishing the shrimp in the body of water. Portability of the final drying apparatus is important, therefore, so that the preliminary cleaning of the harvested shrimp may permit the immediate return of any viable shrimp to the lake. There is therefore an essential need for final cyst drying apparatus which is sufficiently portable to permit practical installation either on the near shore of the body of water or even upon the deck of a shrimp harvesting vessel.

BRIEF SUMMARY OF THE INVENTION

With the foregoing in mind, the present invention eliminates or substantially alleviates the shortcomings and disadvantages of prior art apparatus and methods for drying brine shrimp cysts preparatory for storage in sealed containers. The inventive apparatus comprises a drying chamber into which preliminarily screened, washed and de-watered moist cysts are introduced as soon as possible after harvesting from a body of water. Heated ambient air is introduced into the drying chamber, passing upwardly therethrough to exhaust through a blower at an opening provided at the top of the chamber.

A vertically arranged series of drying trays are mounted inside the chamber from top to bottom. Each tray comprises a floor of large mesh screen. The damp cysts enter at the top of the chamber onto the uppermost of the trays, all of which are sloped sharply downward across the chamber, and each of which is arranged to discharge cysts upon the higher portion of the next lower tray. The lowermost screen in the series, however has a fine mesh screen which allows the separation of broken cyst fragments, making the final dried cyst product of high, uniform viability. The series of trays serves as baffles for both the downward flow of cysts and the upward flow of warmed drying air.

In addition to the drying chamber, the drying apparatus comprises an associated conveyor means which lifts the cysts from the bottom of the chamber to be re-deposited into the uppermost tray, to be further dried upon subsequent passage downward along the several trays. This recirculation process continues until the cysts are thoroughly dried, at which time the cysts are removed from the conveying means into a receptacle. The dried cysts from the receptacle are subsequently placed into cans which are sealed for storage and shipment.

A preferred embodiment of the conveyor means comprises an endless cable within an endless loop of duct immovably attached to the outside of the drying chamber. The endless cable travels continuously within the endless duct about spaced apart sprocket wheels, at least one of which is rotatably powered. Equally spaced apart discs outstand perpendicularly along the full length of the flexible cable.

Cysts being dried are taken from the bottom of the drying chamber into the endless duct at the lowermost sprocket, to be elevated by the discs, which also ingest air through the port, so that the cysts are separated and lifted by the disc by both airborne and mechanical means, to be then deposited through the closing top member of the drying chamber onto the uppermost of the interior trays.

In accordance with a variation of the invention, the endless duct has a pair of horizontal portions each passing through the interior of the drying chamber, one above the highest drying tray and the other at the bottom of the chamber near the lowermost end of the lowermost tray. Cysts enter the endless duct through an upwardly facing opening in the lower horizontal portion of the duct, and subsequently fall into the drying chamber through an elongate downwardly facing opening in the higher horizontal portion. Dried cysts are permitted to fall through a selectively opened, downwardly facing, port in an upper horizontal duct portion outside the drying chamber.

The cyst drying apparatus is preferably free standing and portable, so that it may be installed, if desired, upon the deck of a shrimp harvesting vessel, to receive the newly collected shrimp cysts before hatched live shrimp seined therewith die, losing their restorative pro-creative power for replenishment of the shrimp population in the body of water.

It is the principal object of the invention to provide an economical device for efficiently drying freshly harvested cysts.

BRIEF DESCRIPTION OF THE DRAWING

In the drawings, which represent the best modes for carrying out the invention.

DETAILED DESCRIPTION OF ILLUSTRATED EMBODIMENTS

Figure 1:
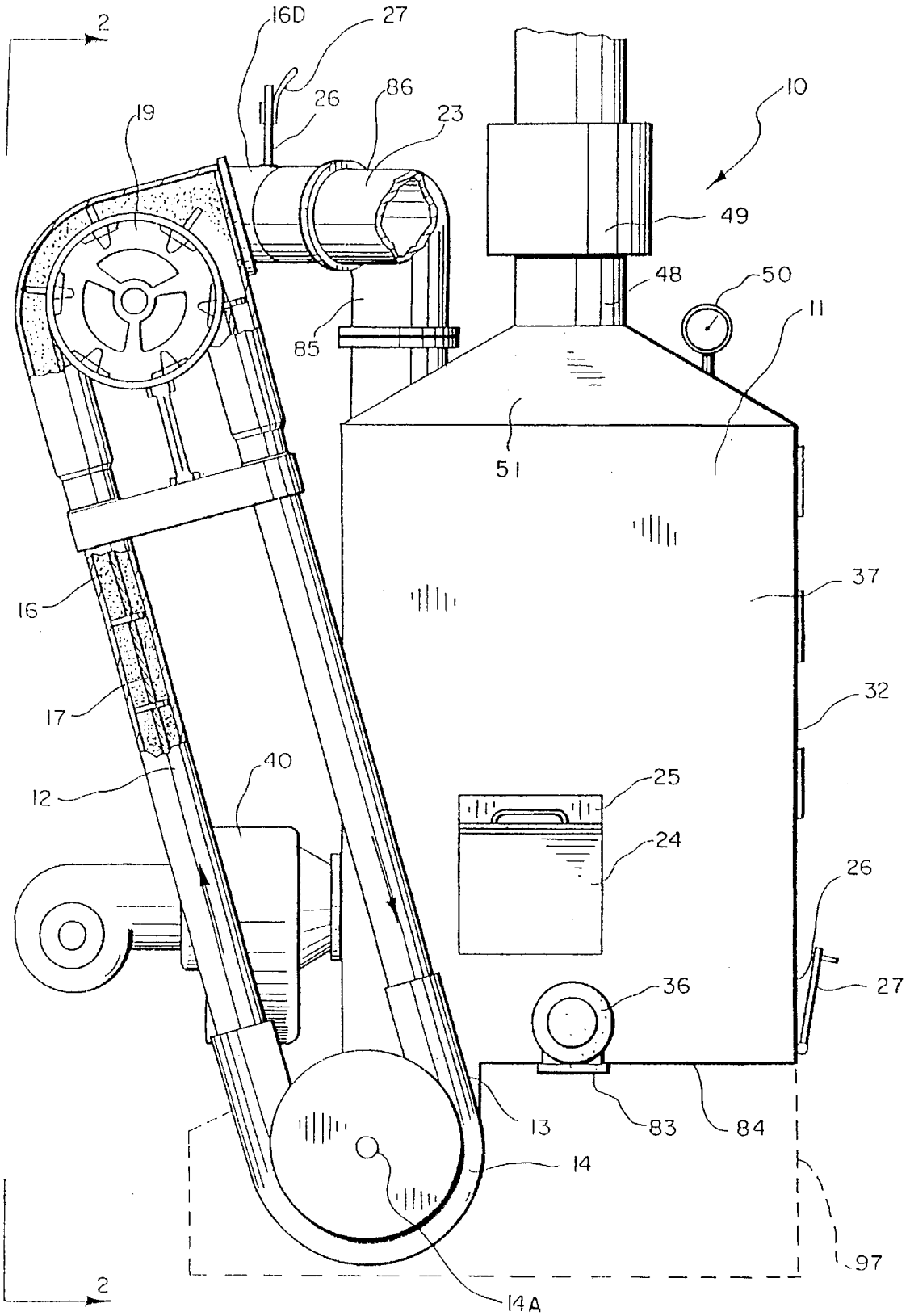
FIG. 1 is an elevation view of one side of a brine shrimp cyst drying device in accordance with the invention, drawn to a reduced scale, FIG. 2 an elevation view of another side of the cyst dryer of FIG. 1 as seen along line 2—2 thereof, drawn to the same scale, FIG. 3 an elevation view of a side of the drying chamber of the drying device of FIG. 1, showing the large hinged access doors, drawn to the scale of FIG. 1, FIG. 4 a vertical cross sectional view of the drying chamber of FIG. 2, taken along line 4—4 thereof, drawn to the same scale, FIG. 5 an elevation view of one side of another preferred embodiment of the cyst drying device in accordance with the invention, drawn to the scale of FIG. 1, FIG. 6 an elevation view of another side of the dryer of FIG. 5, taken along line 6—6 thereof, drawn to the same scale, FIG. 7 a vertical cross sectional view of the drying chamber of the device of FIG. 5, taken along line 7—7 thereof, drawn to the same scale, FIG. 8 a top plan view of one of the drying trays of the devices of FIGS. 1 and 5, drawn a reduced scale, FIG. 9 a side elevation view of the tray of FIG. 8, taken along line 9—9 thereof, drawn to the same scale, FIG. 10 a vertical cross sectional view of a fragment of one of the trays showing its pivotal connection through a bearing block to the wall of the drying chamber, drawn to reduced scale larger than the scale of FIG. 8, FIG. 11 a cross sectional view of the lower end of a typical one of the trays within the drying chamber of the invention, drawn to the scale of FIG. 10, FIG. 12 an elevation view of the fragment of endless duct as shown in FIG. 15, taken along line 12—12 thereof, drawn to the same scale as FIG. 15, FIG. 13 a cut away view of the flow diverter of the drying device of FIG. 1, drawn to approximately the scale of FIG. 1, FIG. 14 a cross sectional view of a fragment of the dryers of FIGS. 1 and 5 showing the tray shaking rod and bearing in association with the rotating, motor powered cam, drawn to the approximate scale of FIG. 11, and FIG. 15 a bottom view of a fragment of the endless duct of the dryer of FIG. 5, showing the cyst depositing opening inside the drying chamber and the selective dry cyst removal port, drawn to a reduced scale.
Figure 2:
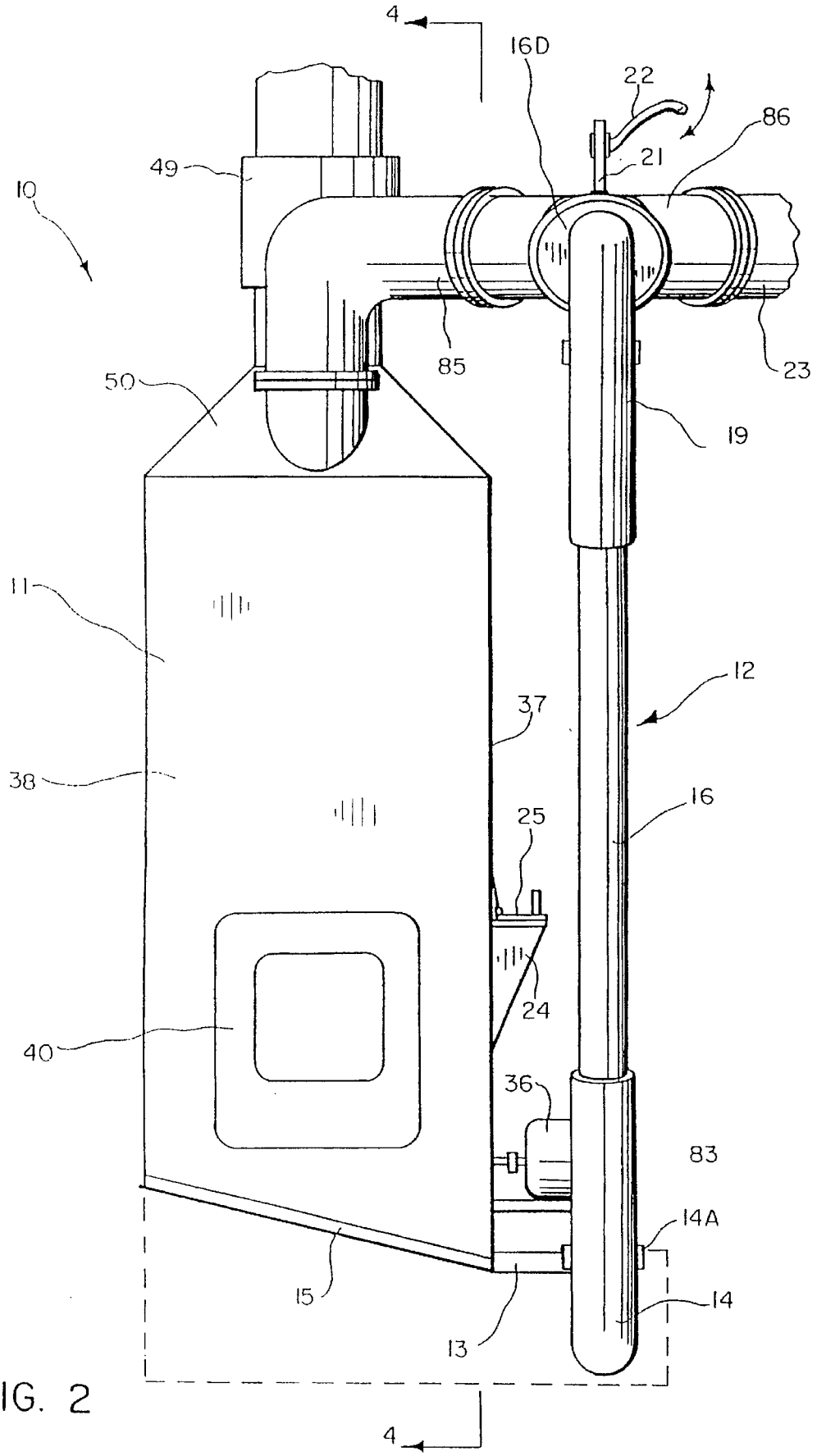
Figure 3:
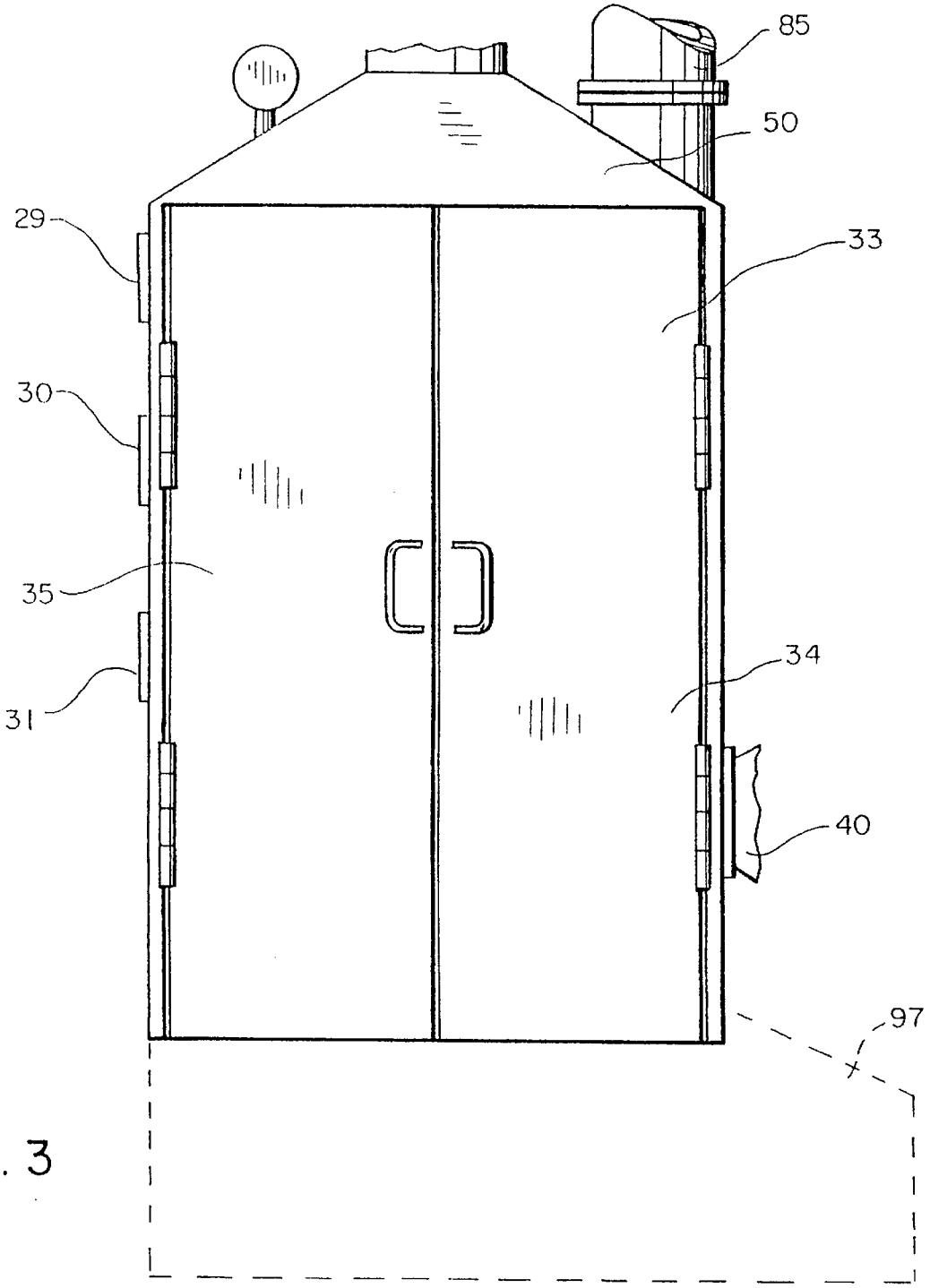

A preferred embodiment of the shrimp cyst drying device 10 comprises a drying chamber 11 in combination with a cyst conveyor 12, mounted integrally to chamber 11 by conventional bracketing, not shown, and is connected to a lowermost cyst outlet conduit 13 from drying chamber 11. (FIGS. 1–4) Conduit 13 connects with endless duct conveyor 12 at driving sprocket 14. Driving sprocket 14 is powered rotationally through driving axle 14A by a suitable conventional powering device, not shown. The cysts leave chamber 11 through conduit 13 which is installed aligned with a cyst collecting trough 15. Conveyor 12 comprises an endless loop 16 of duct in which continuously travels an endless cable 17 carrying spaced apart discs 18 which lift the cysts upwardly from inlet conduit 13. Cyst lifter 12 ingests air along with the cysts, which is drawn in by the moving discs 18 on moving endless cable 17.

Figure 13:
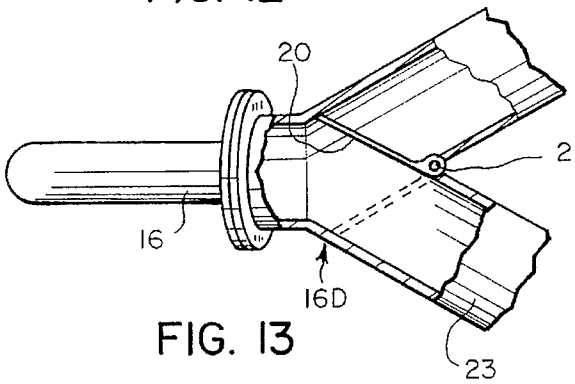
Figure 11:
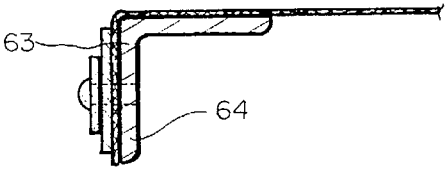

At the uppermost point of loop 16, the cysts are blown centrifugally from a guiding sprocket 19 into "Y" diverter 16D, having an interior vane 20 (FIG. 13), mounted upon a shaft 21 and operated by a handle 22. (FIGS. 1 & 2) Vane 20 selectively directs the flow of airborne cysts, if still excessively moist, back to drying chamber 11, through duct 85, or to a dried cyst outlet duct 23 leading to receptacle bags, for example, not shown.

Figure 4:
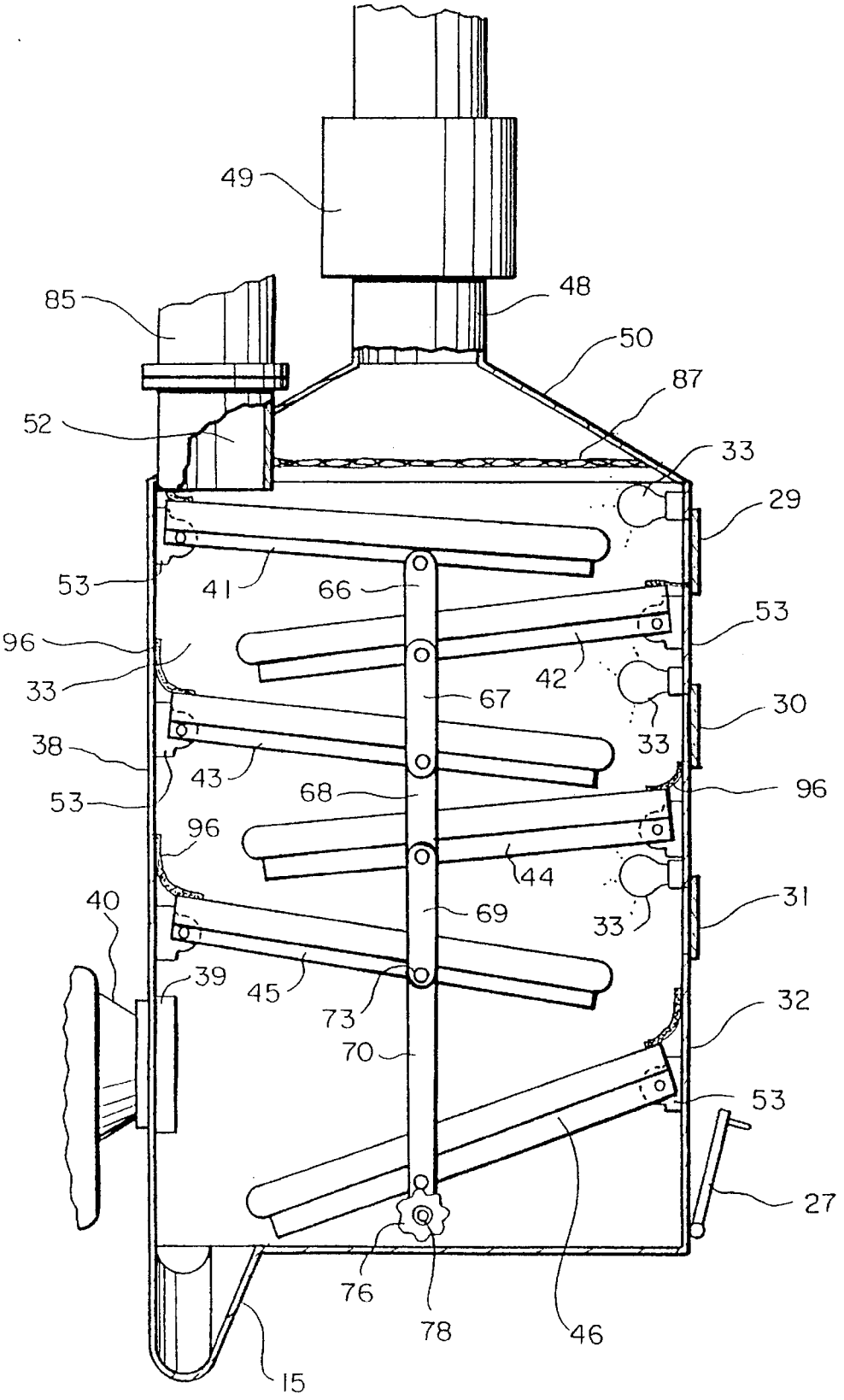
Figure 8:
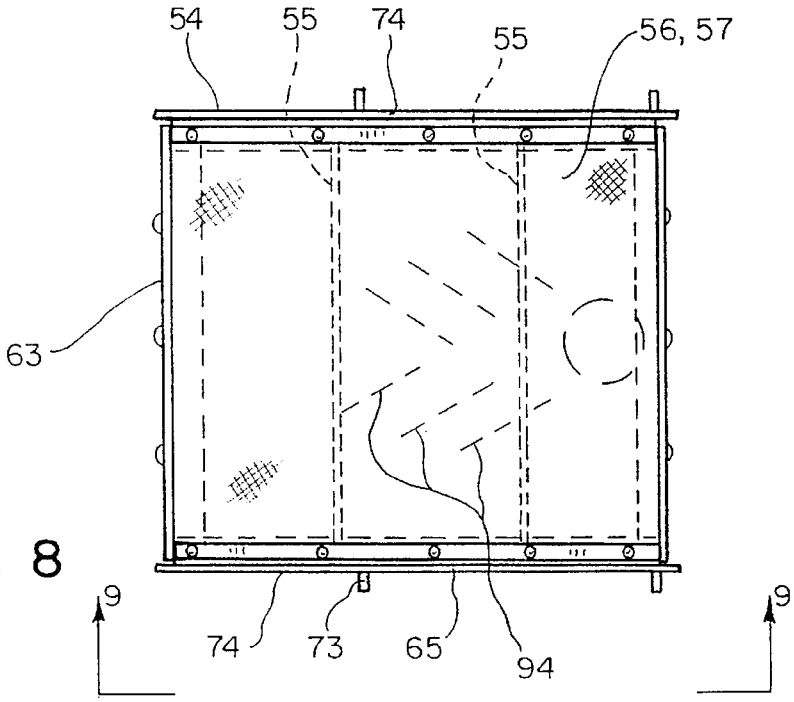
Figure 9:
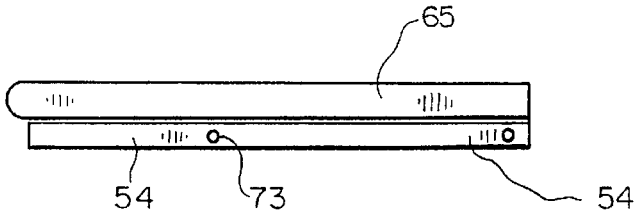

A loading hatch 24 with a hinged cover 25 in wall 37 is used for initial introduction of moist cysts into chamber 11. The cysts being dried may also be sampled through loading hatch 24, by using a long handled sample dipper, not shown, to decide whether to further circulate the cysts through the drying chamber, or to divert them to the aforementioned storage receptacle. Further access to the interior of drying chamber 11 includes a broken cyst removal opening 26 through wall 32 closed by hinged door 27. As later explained in more detail, broken cysts are separated by a screen forming the bottom of a lowermost tray 46 inside chamber 11. (FIGS. 4, 8 & 9)

Visual inspection of the interior of drying chamber 11 is made through windows 29, 30 and 31 vertically spaced along wall 32 of chamber 11. A light 33 is provided near each window to illuminate the interior trays.

A pair of large hinged doors 34 and 35 comprise wall 33 of drying chamber 11. (FIG. 3) A tray-shaking motor 36 is mounted outside of wall 37. (FIGS. 1–5 & 14) The remaining wall 38 of drying chamber 11 is pierced by heated air inlet duct 39 mating with an ambient air heater and blower assembly 40.

Warmed air entering chamber 11 through duct 39 flows upwardly over around and through vertically spaced drying trays 41–46, to exit through exhaust duct 48 through top closure member 51, connected to an exhaust blower 49 diagrammatically shown. (FIG. 1) Preferably, the pressure within chamber 11 is maintained slightly below ambient atmospheric pressure during drying operations. This prevents any leakage of cyst entraining air out of chamber 11, although all openings when closed are sealed with conventional weather stripping, not shown. Electronic pressure sensors and associated control devices, not shown, may be provided for operation of heater/blower 40 and exhaust blower 49 to maintain chamber pressure to a desired value. Or, manual control may be utilized based on visual pressure indication such as may be provided by an absolute pressure gauge 50 upon, for example, top closing member 51. (FIG. 1)

The drying trays 41 through 46 are mounted vertically spaced apart inside drying chamber 11, with each tray sloping substantially downward, excepting bottom tray 47, extending to the vicinity of the higher end of the next lower tray near the opposing wall. The cysts to be dried are deposited upon top tray 41 through chamber inlet tube 52, and then cascade downwardly from tray to tray to reach bottom tray 46 and trough 15. (FIG. 4)

Figure 10:
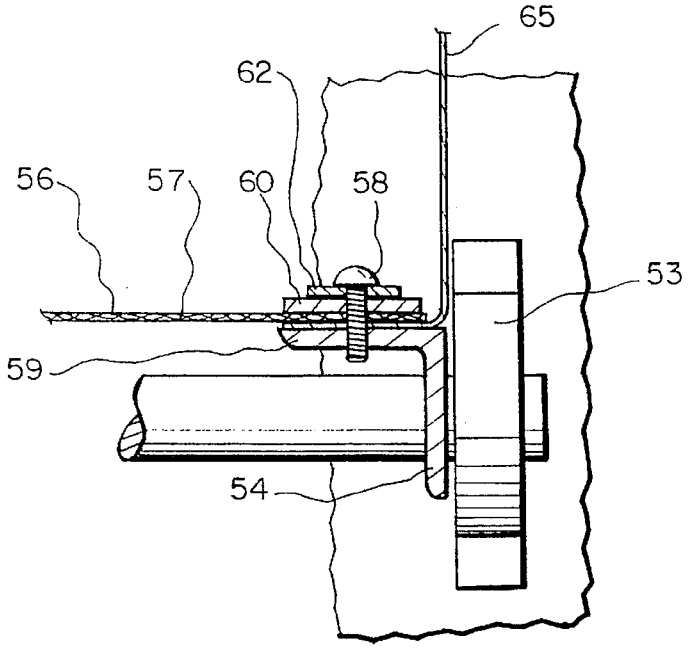

Each tray is secured at its higher edge to the adjacent wall of chamber 11, preferably through a pair of bearing blocks 53, shown in FIG. 10 and indicated in dashed lines in FIG. 4. Each tray comprises a frame of 2" by 2" angles 54, preferably of iron. (FIGS. 8–11) Cross members 55 of ¼" strap support a coarse mesh bottom screen 56 in trays 41 through 45, with a finer mesh screen 57 being used in tray 46, the latter passing only broken cysts smaller than sound viable cysts.

Each screen is secured to frame angles 54 by screws 58 engaging tapped holes in horizontal legs 59 of framing members 54. A strip of flexible material 60 is installed in contact with the edges of the screens, and is in turn clamped by ⅛" metal strap 62 by the screws 58. At the tray discharge ends 63, the vertical leg 64 of the framing members are similarly utilized. (FIG. 11) Along both sides of each of the trays, a cyst retaining side board 65, of ten gauge steel for example, is also secured by the clamping action of straps 52, strips 61 and screws 58. (FIGS. 9 & 10)

The side framing members of trays 41–46 are secured serially together top to bottom of chamber 11 by end pivoting links 66–70, each having a pivot bore at each end engaged by a horizontal pivot rod 73 extending through tray frame side members 54. The links on both sides of the trays are preferably vertically aligned, although considerable amount of misalignment would not impair the operation of the drying device 10. At bottom tray 46, pivot rod 73 preferably carries at each end a ball bearing assembly 75, each of which rides upon a rotating cam 76 with multiple rounded lobes 77. (FIGS. 4 & 14) The pair of cams 76 are each rigidly secured to a cam rod 78 supported at wall 37 and wall 38 of drying chamber 11.

At wall 37, rod 73 is supported by rod bearing block 79. At wall 38, a chamber frame mounted bearing block, not shown, supports the opposite end of the tray 46 pivot rod 73, allowing door 38 to open and close without obstruction. At wall 37, cam rod 78 is connected through an axle coupler 80 to the rotating output shaft 81 of motor 36, which is supported by motor mounting plate 83 welded to chamber bottom member 84. (FIGS. 1 & 2) Upward and downward pivoting motion imparted to lowermost tray 46 is transmitted by links 66 through 70 to the higher trays 41 through 45, assuring continuous cyst flow from tray to tray, as well as agitating the mass of cysts for improved contact with the warmed drying air.

During operation of drying device 10, moist cysts are introduced into the upper part of drying chamber 11 through a cyst inlet duct 85 which connects chamber inlet tube 52 with a flow selecting "Y" 86. The cysts fall through inlet tube 52 assisted by a downward stream of air of substantial velocity, preventing any blowback of airborne cysts, as well as aiding the spread of cysts across the uppermost tray 41. A cyst impervious screen 87 is preferably provided installed across the top of drying chamber 11, to intercept any scatter of undried cysts towards drying air outlet duct 48. Splatter of cysts over the wall-connected ends of the trays is prevented by flexible flaps 96 secured to adjacent wall 32 or 38 and overlapping any gap between wall and the end of the tray.

The cysts deposited upon tray 41 flow, slide and tumble downward to cascade from its lower end to the next succeeding tray 42 and then along all of the trays, continuous flow ensured by the downwardly sloping, vertically vibrating trays. The moist cysts may be expected to distribute sideways to cover all or most of the screen of tray 41. However, a flaring end, not shown, to inlet tube 52 may be employed to assist in initial lateral distribution. Other measures may also be taken, such as upstanding vanes 94, indicated diagrammatically in dashed lines in FIG. 8.

Figure 6:
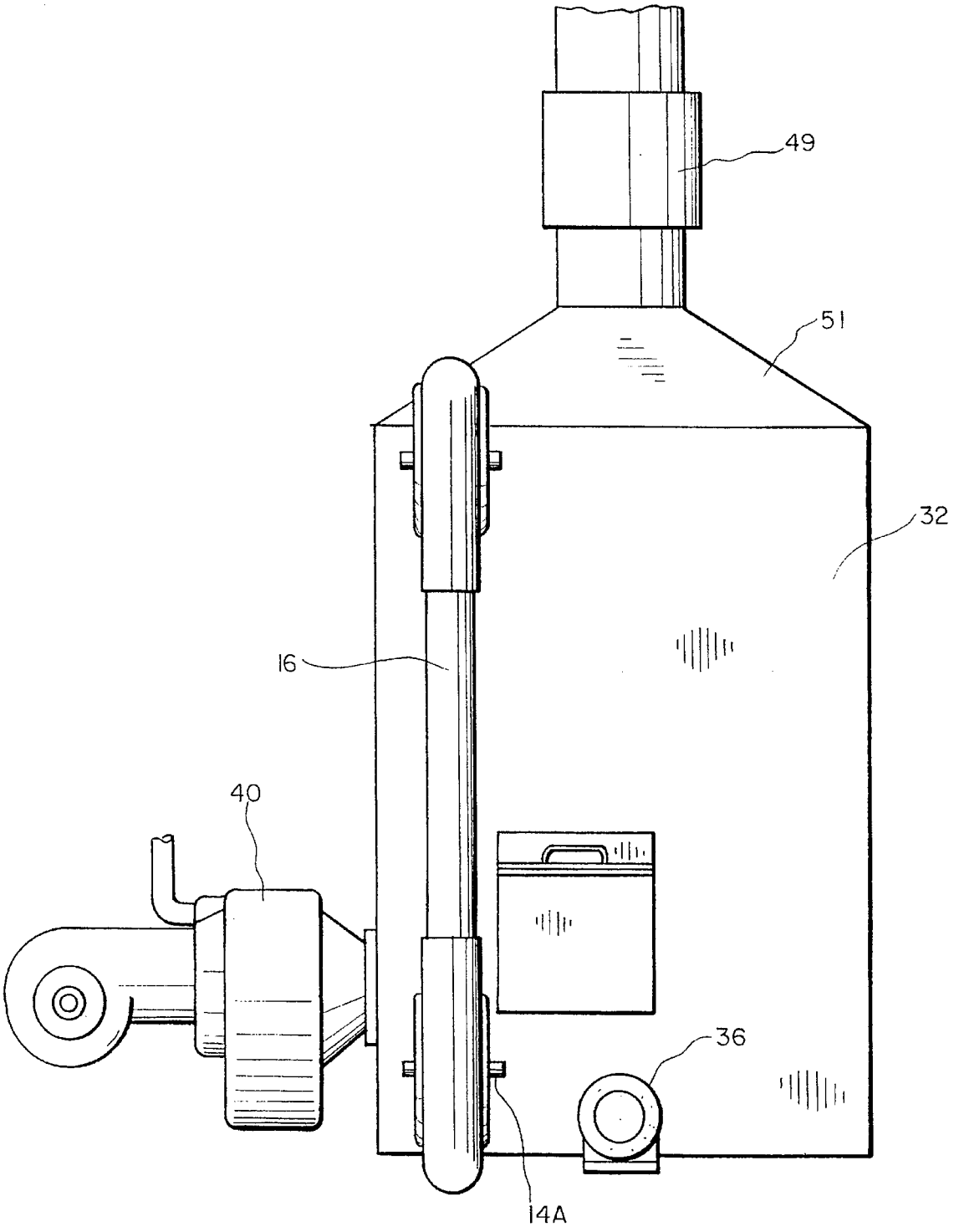
Figure 7:
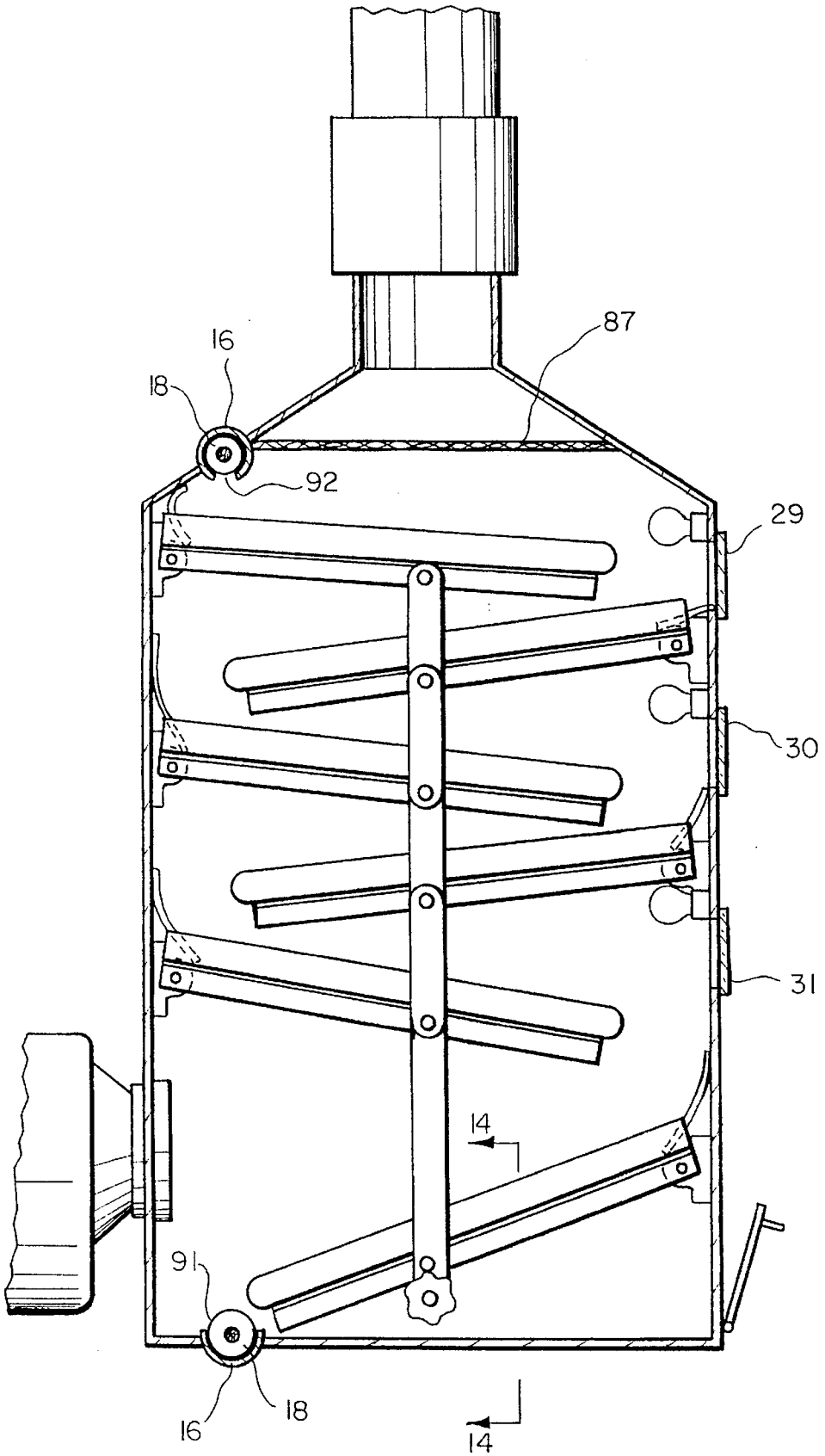
Figure 15:
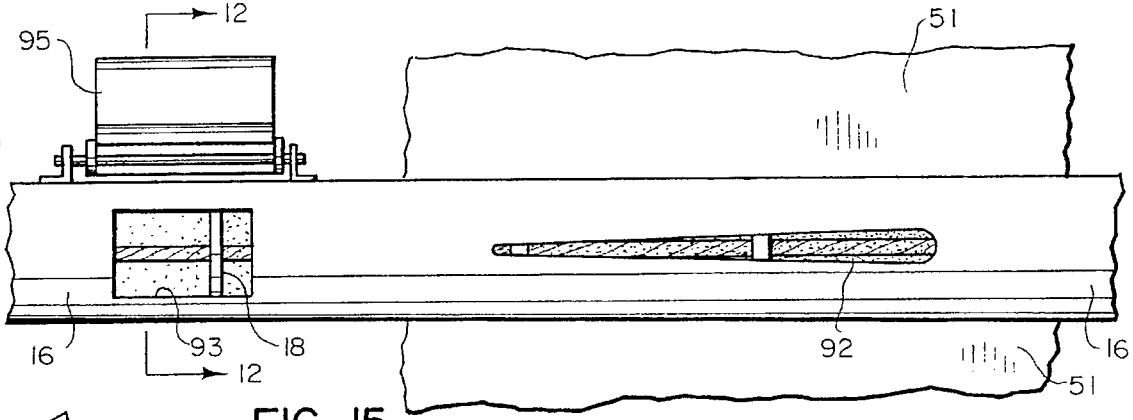
Figure 14:
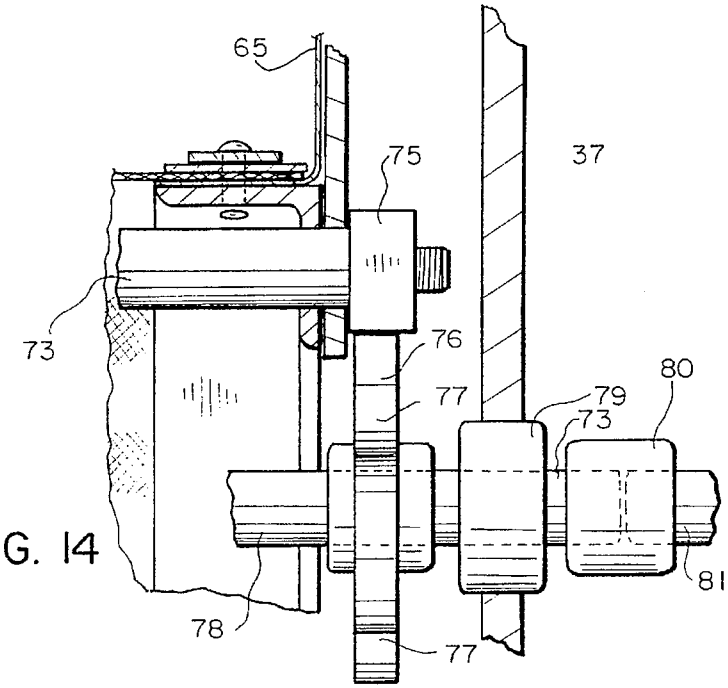

In another preferred embodiment of the cyst drier 10, (FIGS. 5–7), the cyst lifting apparatus still comprises the circulation of discs 18 on endless cable 17 within an endless duct 16. However, in this embodiment, the endless duct passes through both the top and bottom of the interior of chamber 11, at top closing member 51 and at chamber bottom member 84. Unpowered cable guiding sprocket wheels 88, 89 and 90 are required, along with a power drive sprocket 14. In this embodiment, the cysts enter duct 16 through an upwardly facing elongate opening 91 at the bottom of chamber 11. The entering cysts are mechanically engaged by discs 18, and are also pulled into duct 16 by air ingested from the interior of chamber 11. At the top of chamber 11, cyst transporting duct 16 is pierced with an elongate slot 92 through which the cysts fall downwardly onto uppermost tray 41 at its higher end. (FIGS. 7 & 15) Slit 92 may be configured to distribute the incoming cysts evenly, by tapering or the like, not shown.

Figure 12:
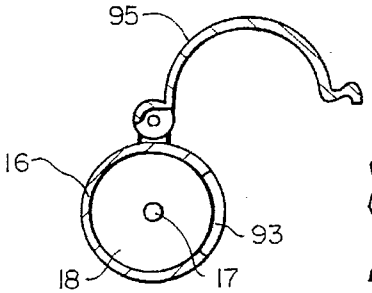

Cysts deposited through slit 92 onto upper tray 41 travel downward over the remaining trays as in the previously described embodiment. When at the proper moisture content, the cysts are removed from duct 16 through a downwardly facing port 93 in a horizontal portion of duct 16, opened by retraction of hinged cover 95. (FIGS. 5 & 12)

Figure 5:
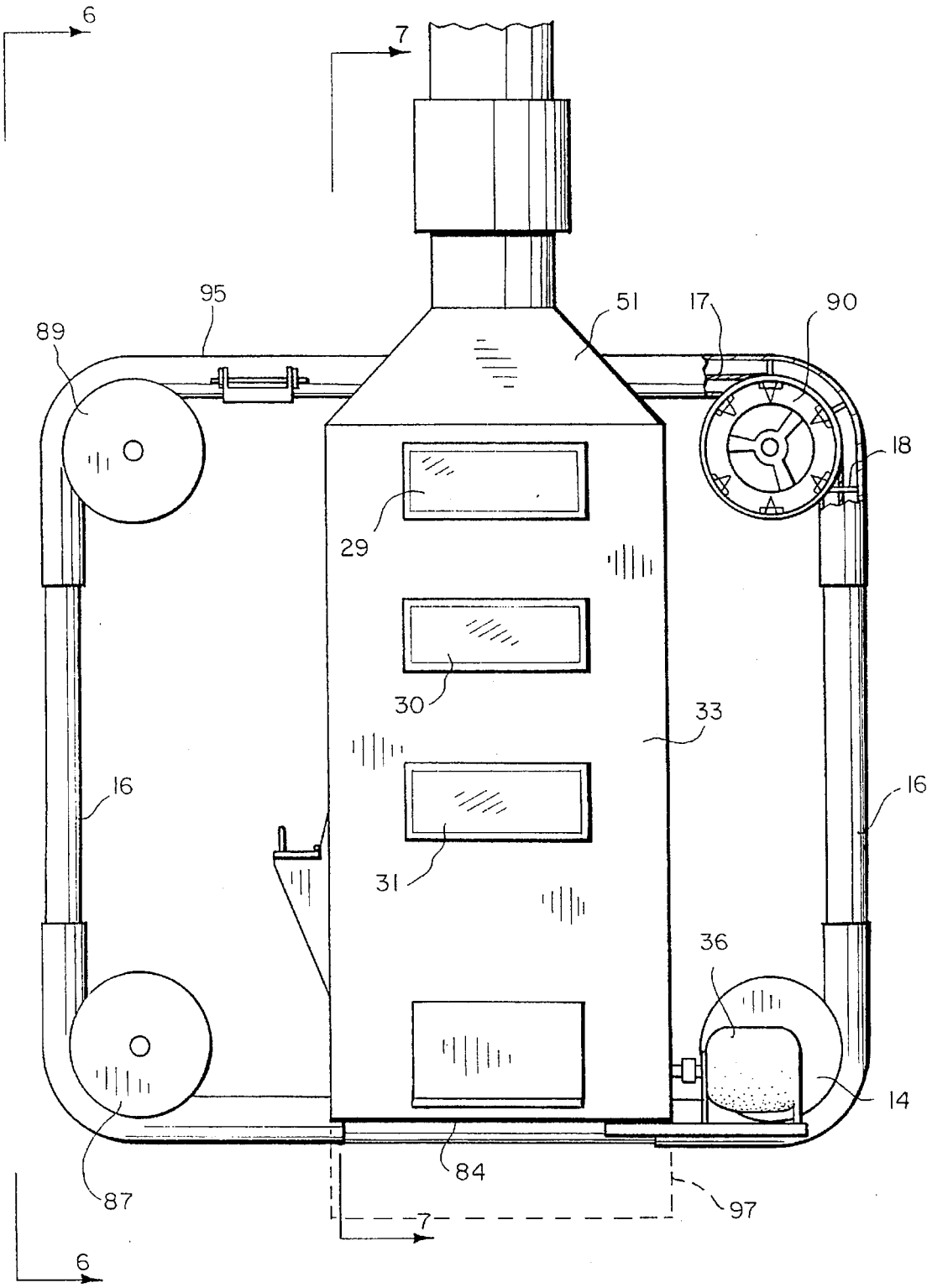

Both illustrated embodiments of cyst dryer 10 are preferably portable, as indicated diagrammatically by a supporting skirt 97 downstanding from the bottom member 84, of chamber 11, indicated in dashed lines in FIGS. 1 and 5 for the respective preferred embodiments.

The inventive apparatus may be embodied in other specific forms, and the method of other specific steps, without departing from the spirit or essential characteristics thereof. The present apparatus and method are therefore to be considered illustrative and not restrictive, the scope of the invention being indicated by the appended claims rather than by the foregoing description and all changes which come within the meaning and range of equivalency of the claims are therefore to be embraced therein.

What is claimed and desired to be secured by United States Letters Patent is:

1. An apparatus for drying brine shrimp cysts, comprising:

a generally closed drying chamber having a bottom member with two pairs of spaced apart parallel sidewall members upstanding therefrom, and a top closing member secured to the sidewall members;

at least one warmed air inlet opening to the chamber through a sidewall member;

an air outlet opening through the top closing member;

means introducing cysts to be dried into the chamber at a level above the bottom member; and means elevating the cysts upwardly from the bottom member of the chamber to a higher level therein to fall under the influence of gravity to said bottom member.

2. The cyst drying apparatus of claim 1, further comprising:

downwardly sloped falling cyst baffle means within the drying chamber.

3. The apparatus of claim 2, wherein the baffle means comprises:

a vertically arranged series of at least two downwardly sloped cyst drying trays installed within the drying chamber downwardly from the top closing member, each tray extending to substantially span between the pairs of opposing sidewall members, alternate ones of said trays sloping downwardly from opposing sidewall members of one of the pairs of spaced apart sidewall members.

4. The apparatus of claim 3, further comprising:

means vibrating at least the cyst drying trays.

5. The apparatus of claim 4, wherein:

each tray of the series is at its uppermost end secured horizontally pivotal to the sidewall member adjacent thereto;

each tray of the series is secured to the immediately lower tray of the series by at least one generally vertical rigid links, said link being pivotally connected at opposing ends to each of said trays; and the means vibrating the trays operates upon at least one of the trays of said series.

6. The apparatus of claim 1, wherein:

the cyst elevating means comprises a conveyor including;

a stationary endless loop of tubular duct secured immovably to the drying chamber;

an endless loop of flexible cable installed within the duct, carrying at spaced intervals therealong a multiplicity of discs each secured perpendicularly to said cable, at least one rotationally powered sprocket wheel engaging the discs to propel the disc carrying cable continuously through the endless tubular duct;

at least one sprocket wheel guiding the endless loop of cable to travel within the endless duct;

cyst inlet means to the endless duct in the vicinity of the bottom member of the drying chamber;

cyst outlet opening means from the endless duct in the vicinity of the drying chamber top closing member, communicating with the interior of said chamber; and dried cyst outlet means from the endless duct outside the drying chamber.

7. The apparatus of claim 6, wherein:

the endless loop of duct is everywhere exterior to the drying chamber;

the cyst inlet means comprises a duct installed to connect the bottom of the drying chamber to the interior of the endless duct;

the cyst outlet opening means from the endless duct comprises an opening to the interior of said duct, an opening through the top closing member of the drying chamber, and a cyst carrying tube connecting said openings, said cyst carrying tube having a portion at the cyst outlet opening directed tangentially to the endless loop of duct at the guiding sprocket wheel, and means selectively opening and closing said cyst carrying tube; and the dried cyst outlet means comprises an opening from said cyst carrying duct, dried cyst duct means connected to said opening, and means selectively opening and closing said dried cyst opening.

8. The apparatus of claim 6, wherein:

the endless loop of duct is everywhere exterior to the drying chamber;

the cyst inlet means comprises a duct installed to connect the bottom of the drying chamber to the interior of the endless conveyor duct;

the cyst outlet opening means from the endless duct comprises an opening to the interior to the endless duct, an opening through the top closing member of the drying chamber, and a cyst carrying tube connected at one end to said endless duct opening, said cyst carrying tube being directed tangentially to the endless loop of duct at the guiding sprocket wheel and being connected at the other end to a double branched flow selector, one branch thereof being connected by a drying chamber inlet tube to the opening through the top closing member of said drying chamber and the other branch thereof being connected to a tube to a dried cyst receptacle, said flow selector further comprising externally operated means for simultaneously closing a selected one of the receptacle branch and the chamber inlet branches and opening the other.

9. The apparatus of claim 6, wherein:

at least an upper portion of the endless loop of duct is horizontal and passes through the interior of the drying chamber in the vicinity of the top closing member;

at least a lower portion of the endless loop of duct at the bottom member of the drying chamber is horizontal and has at least an upper side thereof within the drying chamber;

the cyst inlet means to the endless stationary duct comprises an upwardly facing elongate opening in said upper side of the endless duct inside the drying chamber at the bottom member;

the cyst outlet means from the stationary endless duct into the drying chamber comprises a downwardly facing elongate opening in the portion of the endless duct inside the drying chamber in the vicinity of the top closing member;

the dried cyst outlet means from the endless duct comprises a downwardly facing opening in the upper horizontal portion of the endless duct entering said chamber exterior to said drying chamber; and means selectively opening and closing the dried cyst outlet means.

* * * * *